US005255503A

United States Patent [19]

Räder et al.

[11] Patent Number: 5,255,503

[45] Date of Patent: Oct. 26, 1993

[54] FRICTIONAL FALSE-TWISTING UNIT WITH ELECTROMOTIVE DRIVE

[75] Inventors: Wolfgang Räder, Schonungen; Günther Paul, Hammelburg, both of Fed. Rep. of Germany

[73] Assignee: FAG Kugelfischer Georg Schafer KGaA, Fed. Rep. of Germany

[21] Appl. No.: 832,056

[22] Filed: Feb. 6, 1992

[30] Foreign Application Priority Data

Mar. 30, 1991 [DE] Fed. Rep. of Germany ..... 4110464

[51] Int. Cl.[5] ..... D01H 7/92; D01H 13/00

[52] U.S. Cl. ..... 57/104; 57/89; 57/100; 57/105; 57/339

[58] Field of Search ..... 57/100, 104, 105, 89, 57/339

[56] References Cited

U.S. PATENT DOCUMENTS

| | | | |
|---|---|---|---|
| 3,932,985 | 1/1976 | Naylor | 57/105 |
| 4,060,967 | 12/1977 | Lorenz | 57/104 X |
| 4,124,974 | 11/1978 | Taylor | 57/339 |
| 4,485,617 | 12/1984 | Schmitt et al. | 57/104 X |
| 4,559,775 | 12/1985 | Oberstrass | 57/105 X |
| 4,566,262 | 1/1986 | Schmucker | 57/264 |
| 4,566,265 | 1/1986 | Naylor | 57/105 X |
| 4,584,831 | 4/1986 | Schuster et al. | 57/339 |
| 4,698,959 | 10/1987 | Schippers et al. | 57/105 X |

FOREIGN PATENT DOCUMENTS

| | | | |
|---|---|---|---|
| 4001957 | 7/1991 | Fed. Rep. of Germany . | |
| 2450889 | 11/1980 | France | 57/339 |
| 1222435 | 2/1971 | United Kingdom . | |
| 1448027 | 9/1976 | United Kingdom . | |
| 2212176 | 7/1989 | United Kingdom . | |
| 2240346 | 7/1991 | United Kingdom | 57/339 |

*Primary Examiner*—Daniel P. Stodola
*Assistant Examiner*—William Stryjewski
*Attorney, Agent, or Firm*—Ostrolenk, Faber, Gerb & Soffen

[57] ABSTRACT

A frictional false twisting unit including a plurality of driven shafts, a driven pulley on one of the shafts, an externally arranged motor with a drive shaft, an endless loop toothed belt between the drive shaft and the driven pulley. The shafts are on a carriage or base plate which is moveable or swingable with respect to either the motor or a base plate on which the motor is disposed. The shaft carrying base plate or carriage is movable to slacken the toothed belt, enabling removal of the driven pulley from the toothed belt and removal of the shafts from the unit. The thread monitoring devices of the unit remain with the unit while the shafts are removed. Channels for the lateral runs of the toothed belt prevent excessive spread of the belt when it is slack and when the driven pulley is removed. A guide beneath the belt prevents the belt from moving down axially when the belt is slack and the driven pulley is removed.

17 Claims, 3 Drawing Sheets

FRICTIONAL FALSE-TWISTING UNIT WITH ELECTROMOTIVE DRIVE

BACKGROUND OF THE INVENTION

The present invention relates to a frictional false twisting unit and particularly relates to the guidance of the drive belt for the shafts of the unit.

Known frictional false twisting units generally include three shafts which are arranged in an equilateral triangle and which carry overlapping and interleaved friction disks. The shafts and the disks thereon are rotated by either a tangential belt, which frictionally drives at least one shaft, or by an electric motor, where the motor is integrated with; i.e., it is installed on, one of the shafts, or else the motor is mounted externally on a base plate. The drive from an externally arranged motor is to one of the shafts and that drive is effected predominantly by a toothed belt which drives the one of the three shafts. The other two shafts are connected by other means, e.g. by other belts, to be driven by the one shaft.

Such a false twisting unit is described in Federal Republic of Germany Patent 4001957.8. By means of a toothed belt, the externally arranged motor drives with friction disks, are also driven by toothed belts. This construction has the disadvantage that both the motor and the false twisting unit itself are installed on a single piece base plate. When cleaning, or repair, or the like are to be done, the complete unit, including the motor, must be removed from the machine. This removal and subsequent remounting affect the electrical installations, the thread tension measuring device and other thread monitoring devices.

SUMMARY OF THE INVENTION

It is an object of the present invention to provide a frictional false twisting unit which can be removed from the machine when required, but wherein the motor and other highly sensitive parts can remain in the machine.

A frictional false twisting unit includes a plurality of disk supporting shafts which are driven to rotate, and these shafts in turn spin overlapping and interleaved disks on the shafts, to impart a false twist to yarn drawn past the interleaved disks. There is an externally arranged motor with a drive shaft and a drive pulley on that shaft. The motor is fastened onto a first base plate which is mounted on a spindle bearing plate inside the machine. There is a driven pulley on one of the disk supporting shafts. An endless loop, toothed belt extends between the drive pulley and the driven pulley.

The disk supporting shafts of the friction false twisting unit are on a carriage or base plate which is moveable with respect to the motor, i.e. a base plate on which the motor is disposed, so as to slacken the toothed belt. This enables removal of the driven pulley from the toothed belt and removal of the disk supporting shafts from the unit. The thread monitoring devices of the false twisting unit remain with the unit while the disk supporting shafts are removed.

The carriage or base plate- of the disk supporting shafts is shiftable or swingable with respect to the base plate of the motor for adjusting the slack and tension in the toothed belt. The moveable carriage or base plate and the driven shaft thereon are moved toward the first base plate to loosen the toothed belt from the driven pulley of the false twisting unit. Under the resulting slackened condition of the belt, the false twisting unit can easily be lifted off the shifted carriage or base plate for repairs and can be easily replaced and reinstalled. Once the false twisting unit is back in place, the shaft supporting carriage or base plate is restored to its previous belt tight position.

The lateral runs of the toothed belt are guided through a channel or channels which prevent excessive spread of the belt loop runs when the belt is slack and when the driven pulley is removed. The channel is adapted to the width of the permitted spread of the toothed belt and is adapted to the length of the stroke of or to the extent of the swinging movement of the driven pulley on the false twisting unit. The endless loop belt has two oppositely moving runs or courses, and the channel or channels preferably holds both belt courses to guide the spread of the belt width.

In order to avoid the slackened toothed belt falling from its position, in the axial direction along the drive shaft of the motor or the length of the driven shaft, a guide beneath the belt prevents the belt from moving down or falling axially when the belt is slack and the driven pulley is removed. This facilitates reinstallation of the carriage or base plate with the disk supporting shafts and the driven pulley.

To avoid uncontrolled shutting down of the unit during operation, a setting lever, with which the disk shaft supporting carriage or base plate is shifted, can be removed from the false twisting unit during normal operation.

Other features and advantages of the present invention will become apparent from the following description of the invention which refers to the accompanying drawings.

DESCRIPTION OF THE PREFERRED EMBODIMENTS

Figure 1:
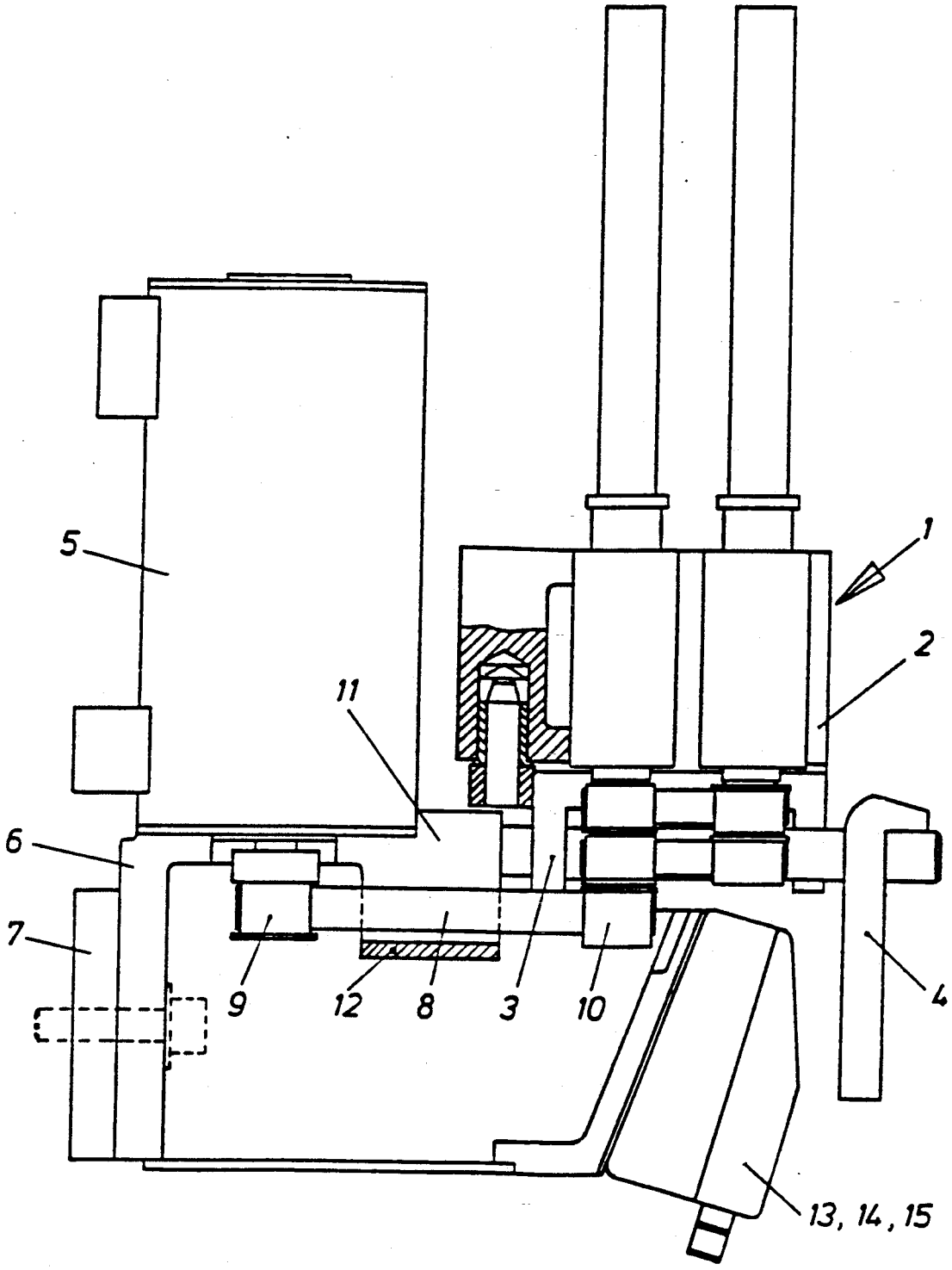
FIG. 1 is a side view of the frictional false twisting unit having the toothed belt guide according to the invention.

FIG. 1 is a side view of a frictional false twisting unit 1. Such a unit is well known, so that its features are mostly shown schematically. The unit 1 includes three rotatably driven shafts, each with respective friction disks on it (not shown), as is well known. The friction disks on the three shafts are overlapped and interleaved. Rotation of the shafts and the disks as yarn is moved past the disks imparts a false twist to the yarn. The unit 1 is fastened onto a first base plate 2 and that plate 2, in turn, is mounted on the movable carriage 3. A setting lever 4 is attached on the carriage 3 and it is grasped to move the carriage. The lever 4 may be removed during normal operation of the unit to prevent inadvertent shifting.

The carriage 3 is guided in or on a second base plate 6 which carries a motor 5. The motor is external to and is to one side of the unit 1. The base plate 6 is fastened to the spindle bearing plate 7. By means of the lever 4, the first base plate 2 can be moved relative to the second base plate 6, which enables slackening or tightening of the toothed belt 8, as described below.

Known monitoring elements, like the thread tension measuring device 13, the rpm monitoring device 14, the thread cutting device 15, etc., are firmly attached to the carriage mount 3. They need not be removed along with the unit 1, which is an advantage of the invention.

The motor 5 has a drive shaft with a drive pulley 9 on it around which an endless loop, toothed belt 8 passes. The belt 8 extends to and passes around the driven pulley 10 of the unit 1. The pulley 10 is on the one shaft of the false twisting unit that is directly motor driven.

Figure 2:
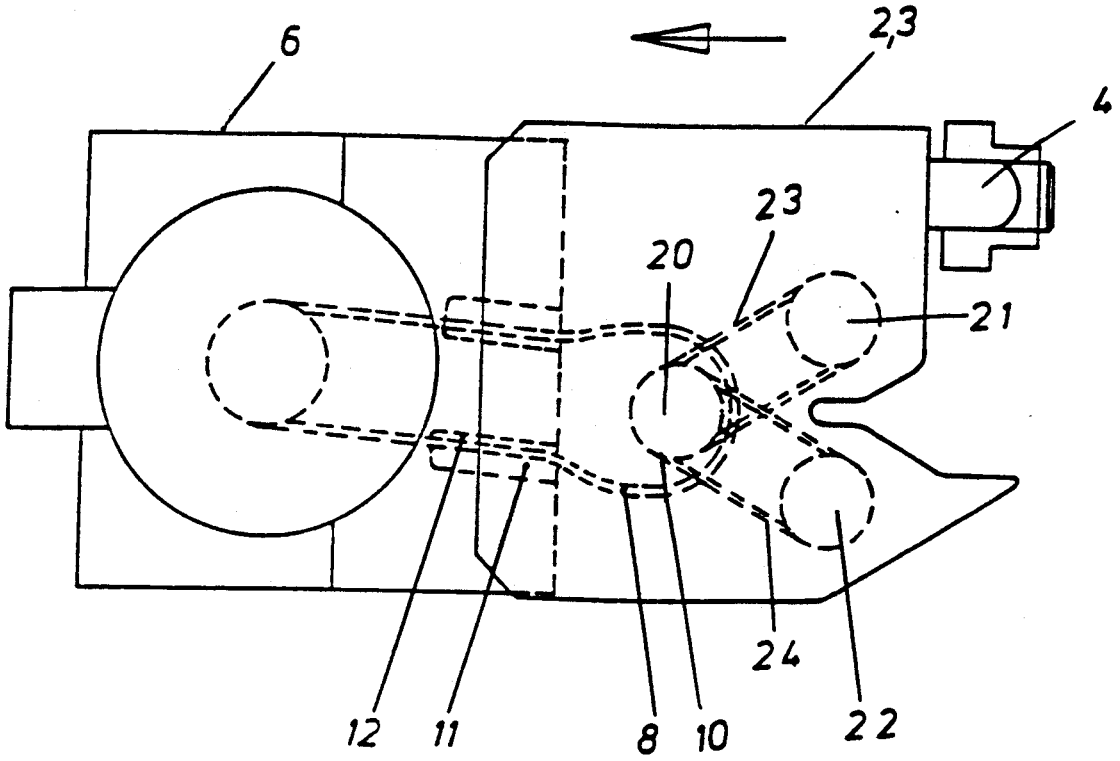
FIG. 2 is a top view showing one embodiment with toothed belt guidance.

Referring to FIGS. 1 and 2, there are channels arranged at both the left and the right courses or runs of the toothed belt 8 to prevent the widening of the loop or the lateral escape of the belt 8 from its path when the belt is slack. The two channels are defined in a channel piece 11 which is provided at the carriage 3 between the motor drive pulley 9 and the driven pulley 10.

To prevent falling or axially downward deviation of the toothed belt 8 from its path toward the driven pulley 10 when the belt 8 is slack, a guide 12 is provided on the channel piece 11 or on the carriage 3 below the toothed belt 8.

FIG. 2 is a top view of the guide for the toothed belt. The loop of the toothed belt 8 is shown in the spread condition around the driven pulley 10. The walls of the channel in piece 11 limit the outward spread of the runs of the slack toothed belt 8. The channels at both opposite runs of the endless loop belt 8 are spaced so that the belt can spread only up to a maximum extent at which the end of the loop can be removed from the driven pulley 10 and, most important, so that the loop can later receive the pulley 10 when the false twisting unit 1 and the pulley 10 are replaced. Axial holding of the belt is effected by the guide 12.

The three shafts of the false twisting unit can be seen. Shaft 20 is driven by the pulley 10 thereon and by the belt 8 around that pulley. Shafts 21 and 22 are driven by belts 23 and 24 which join the latter shafts to the shaft 20. The carriage 3 can be shifted relative to the base plate 6 to adjust the tension of the belt 8.

Figure 3:
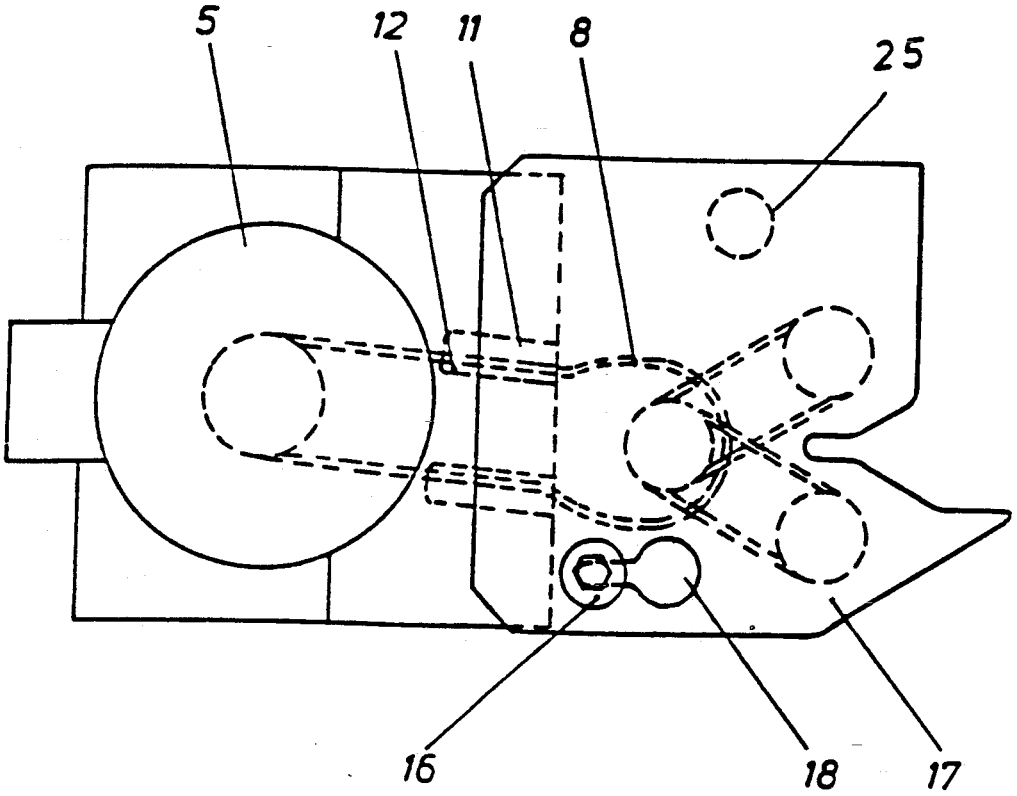
FIG. 3 is a top view of the swingable base plate embodiment with toothed belt guidance.

FIG. 3 illustrates in top view the guidance of the toothed belt in a swingable false twisting unit. Loosening the screw 16 enables the swingable base plate 17 to be swung around the pivot 25 and via the cam slot 18 in the direction toward the motor 5. Although this movement of the base plate 17 slackens the belt 8, the spreading of the toothed belt 8 is limited laterally by the channel walls of the channel piece 11, while the axial guide 12 prevents sagging of the toothed belt 8. Thus, the belt 8 is held in its position to be easily restored to its driving condition when the base plate 17 is returned to its unshifted position, which is the position shown in FIG. 3.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A frictional false twisting unit comprising:

a plurality of rotatable shafts to be driven to rotate for imparting a false twist, the shafts having a radius; one of the shafts having a driven pulley on it;

a drive motor for the unit radially spaced from the rotatable shafts; a drive pulley, and the motor being connected to drive the drive pulley;

an endless loop belt passing between the drive pulley and the driven pulley for driving the driven pulley and the respective shaft thereof to rotate;

driving means for driving the other shafts of the unit to rotate with the one shaft and connected to said driven pulley;

a carriage on which the rotatable shafts are mounted, the carriage being movable in the direction toward the motor which slackens the belt and thereby loosens the belt over the driven pulley such that the shafts, including the driven pulley thereof, can be removed away from the motor and the belt.

2. The frictional false twisting unit of claim 1, wherein the carriage for the shafts of the unit are disposed on a first base plate and the motor is disposed on a second base plate, and the first base plate is moveable with respect to the second base plate for moving the first base plate to slacken the belt.

3. The frictional false twisting unit of claim 2, wherein the first base plate is swingable with reference to the second base plate for moving the driven pulley selectively to slacken and tighten the belt.

4. The frictional false twisting unit of claim 2, wherein the first base plate with the shafts thereon is removable from the second base plate for removing the shafts away from the motor.

5. The frictional false twisting unit of claim 2, further comprising a setting lever attached to the carriage to be held to move the first base plate with respect to the second base plate.

6. The frictional false twisting unit of claim 5, wherein the setting lever is removable from the carriage.

7. The frictional false twisting unit of claim 2, further comprising thread monitoring devices, including a thread tension measuring device, an rpm monitoring device and a thread cutter, supported to the second base plate and separate from the shafts so that removal of the shafts and the driven pulley from the unit does not remove the thread monitoring devices.

8. The frictional false twisting unit of claim 1, wherein the endless loop belt is a toothed belt.

9. The frictional false twisting unit of claim 1, wherein the carriage for the shafts of the false twisting unit is shiftable toward and away from the motor.

10. The frictional false twisting unit of claim 1, wherein a setting lever is removably attached to the carriage.

11. The frictional false twisting unit of claim 1, further comprising channel defining means including a channel therein through which the belt passes and is guided, the channel being shaped, sized and placed to prevent lateral shifting and spread of the endless loop belt upon the belt being slackened and upon removal of the driven pulley from the belt.

12. The frictional false twisting unit of claim 11, wherein the endless loop belt has opposite direction runs and the channel defining means defines channels for both of the opposite direction runs to prevent the lateral shifting and spread of the belt.

13. The frictional false twisting unit of claim 12, wherein the channels defined by the channel defining means are wide enough to permit the toothed belt to spread only a distance wherein the length of the extended slackened tooth belt is long enough that the driven pulley can be removed from inside the loop of the belt and can be inserted inside the loop of the belt.

14. The frictional false twisting unit of claim 11, further comprising a guide disposed beneath the belt for preventing the belt from shifting downward when the belt is slackened and when the driven pulley is out of the loop of the belt.

15. The frictional false twisting unit of claim 14, wherein the guide is arranged generally beneath the channel.

16. The frictional false twisting unit of claim 1, further comprising a guide disposed beneath the belt for preventing the belt from shifting downward when the belt is slackened and when the driven pulley is out of the loop of the belt.

17. The frictional false twisting unit of claim 1, wherein the driving means connects the one shaft to the other shafts for driving the other shafts.

* * * * *